US011882887B2

(12) United States Patent
Williams

(10) Patent No.: US 11,882,887 B2
(45) Date of Patent: Jan. 30, 2024

(54) SHAPEWEAR

(71) Applicant: Vanessa Williams, Austell, GA (US)

(72) Inventor: Vanessa Williams, Austell, GA (US)

( * ) Notice: Subject to any disclaimer, the term of this patent is extended or adjusted under 35 U.S.C. 154(b) by 282 days.

(21) Appl. No.: 17/405,414

(22) Filed: Aug. 18, 2021

(65) Prior Publication Data

US 2023/0053521 A1 Feb. 23, 2023

(51) Int. Cl.
*A41C 1/02* (2006.01)

(52) U.S. Cl.
CPC ..... *A41C 1/02* (2013.01)

(58) Field of Classification Search
None
See application file for complete search history.

(56) References Cited

U.S. PATENT DOCUMENTS 2,424,651 A * 7/1947 Dubner ..... A41C 1/00 2/407
2,437,830 A * 3/1948 McAllister ..... A41B 9/04 D2/704
2,468,346 A * 4/1949 Rayden ..... A41C 1/003 2/408
2,476,585 A * 7/1949 Cohen ..... A41C 1/02 2/408
3,533,412 A * 10/1970 Bayer ..... A41C 1/02 450/131
6,298,486 B1 * 10/2001 Huang ..... A41C 1/003 2/408
6,964,065 B2 * 11/2005 Stevenson ..... A41B 9/04 2/400
8,647,168 B2 * 2/2014 Anvaripour ..... A41C 1/003 450/74
10,555,564 B2 * 2/2020 Brady ..... A41B 9/005
2004/0210990 A1 * 10/2004 Stevenson ..... A41B 9/004 2/406
2008/0207088 A1 * 8/2008 Giugliano ..... A41C 1/06 450/92
2011/0207382 A1 * 8/2011 Kent ..... A41C 1/003 450/11
2013/0095730 A1 * 4/2013 Jensen ..... A41D 1/06 450/95
2015/0157060 A1 * 6/2015 Solano ..... D04B 1/243 66/178 R
2017/0027240 A1 * 2/2017 McClean ..... A41D 1/14
(Continued)

*Primary Examiner* — Jocelyn Bravo
(74) *Attorney, Agent, or Firm* — Lyman Moulton, Esq.; Moulton Patent's, PLLC

(57) ABSTRACT

The disclosure is the only product of its kind that provides users with a nonrestrictive yet effective body shapewear that lifts the breast and buttock, and smooths curves for a flattering look. The disclosure is uniquely designed with a skin friendly material that minimizes rashes or irritation during long term wear and is strategically crafted with a buttock lift connecting strap that depicts a fuller, rounder appearance of the buttocks to achieve an hourglass figure. The disclosure includes an elastic torso comprising a right and a left reinforced side panels, a front reinforced panel, a front and a back panel and a left and a right straps; a right and a left reinforced buttocks panels adjacent the back panel; a sliding crotch panel adjoining the front and the back panels, wherein the sliding crotch panel allows bowel and urinary access and spans a crotch area there between.

16 Claims, 4 Drawing Sheets

(56) References Cited

U.S. PATENT DOCUMENTS

| | | | | |
|---|---|---|---|---|
| 2018/0228665 | A1* | 8/2018 | Relekar | A41B 9/04 |
| 2019/0380408 | A1* | 12/2019 | Tanzman | A61F 5/026 |
| 2021/0315287 | A1* | 10/2021 | Musciacchio | A41D 7/005 |

* cited by examiner

SHAPEWEAR

BACKGROUND

Shapewear has been used for centuries by individuals who seek to portray an all-over sleeker physique. Current shapewear designs, however, are restrictive and require tight bonding with hooks for holding, this in return creates an uncomfortable and, oftentimes, painful experience for the user as they try to complete daily tasks such as going to the bathroom. In addition to the tedious process of removing the hook attachments, modern body shaping garments are mad of latex and rubber inlays that often lead to skin irritation. There have been no products available as original equipment or as an aftermarket to address this problem.

An apparatus or device used for body shapewear that is comfortable, convenient, and comfortable for the skin. There have been no products available as original equipment or as an aftermarket to address this problem either.

There exists a need for device or apparatus of shapewear that is not being met by any known or disclosed device or system of present.

SUMMARY OF THE INVENTION

The main purpose of the disclosure, also known as the Most Comfortable Effective Body Shaper is to provide users with a multipurpose undergarment that enhances and tightens the body's natural curves.

The disclosure includes an elastic torso comprising a right and a left reinforced side panels, a front reinforced panel, a front and a back panel and a left and a right straps; a right and a left reinforced buttocks panels adjacent the back panel; a sliding crotch part or panel adjoining the front and the back panels, wherein the sliding crotch panel allows bowel and urinary access and spans a perineum crotch area there between.

Figure 1:
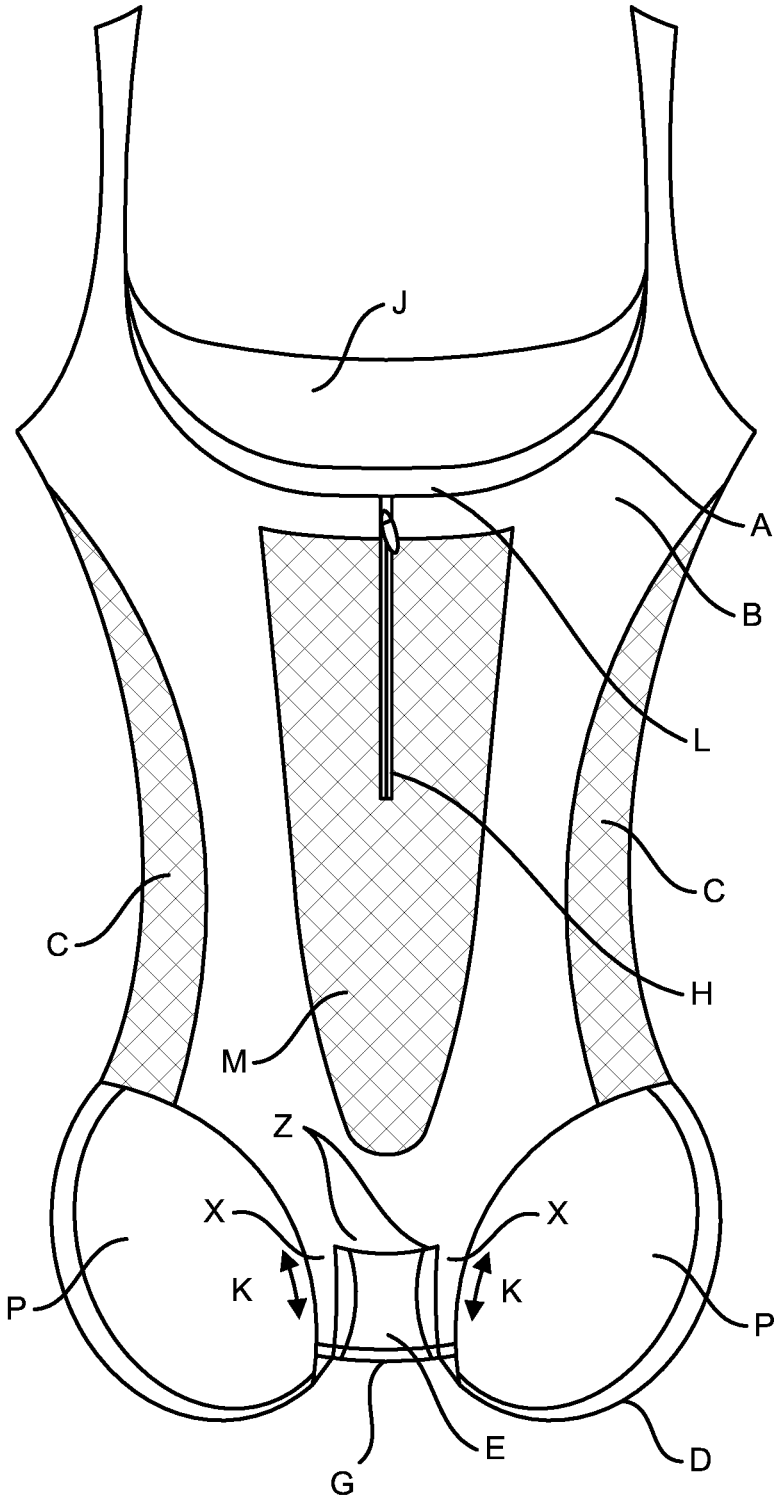
FIG. 1 is a front view of the Shapewear apparatus in accordance with an embodiment of the present disclosure.

Throughout the description, similar reference numbers may be used to identify similar elements depicted in multiple embodiments. Although specific embodiments of the invention have been described and illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

FIG. 1 is a front elevational view of the Shapewear apparatus showing: Breast support/lift referenced as A., Polyester elastic body shaper referenced as B., Reinforced referenced as C., Buttocks lift connecting strap referenced as D., Opening referenced as E., Sliding connection a.k.a a part or panel to fit all bodies referenced as G., Zipper of a conventional type referenced as H., in accordance with an embodiment of the present disclosure. The front view also includes the sliding crotch directional arrows K, the back panel J and the lift lip L and the front reinforced panel M and the left and the right reinforcing buttocks panels P. A crotch portion X and interlocking or sliding longitudinal seams/edges ZL and ZR, also known as zip lock longitudinal seams or zippers herein are also illustrated and detailed below.

Figure 2:
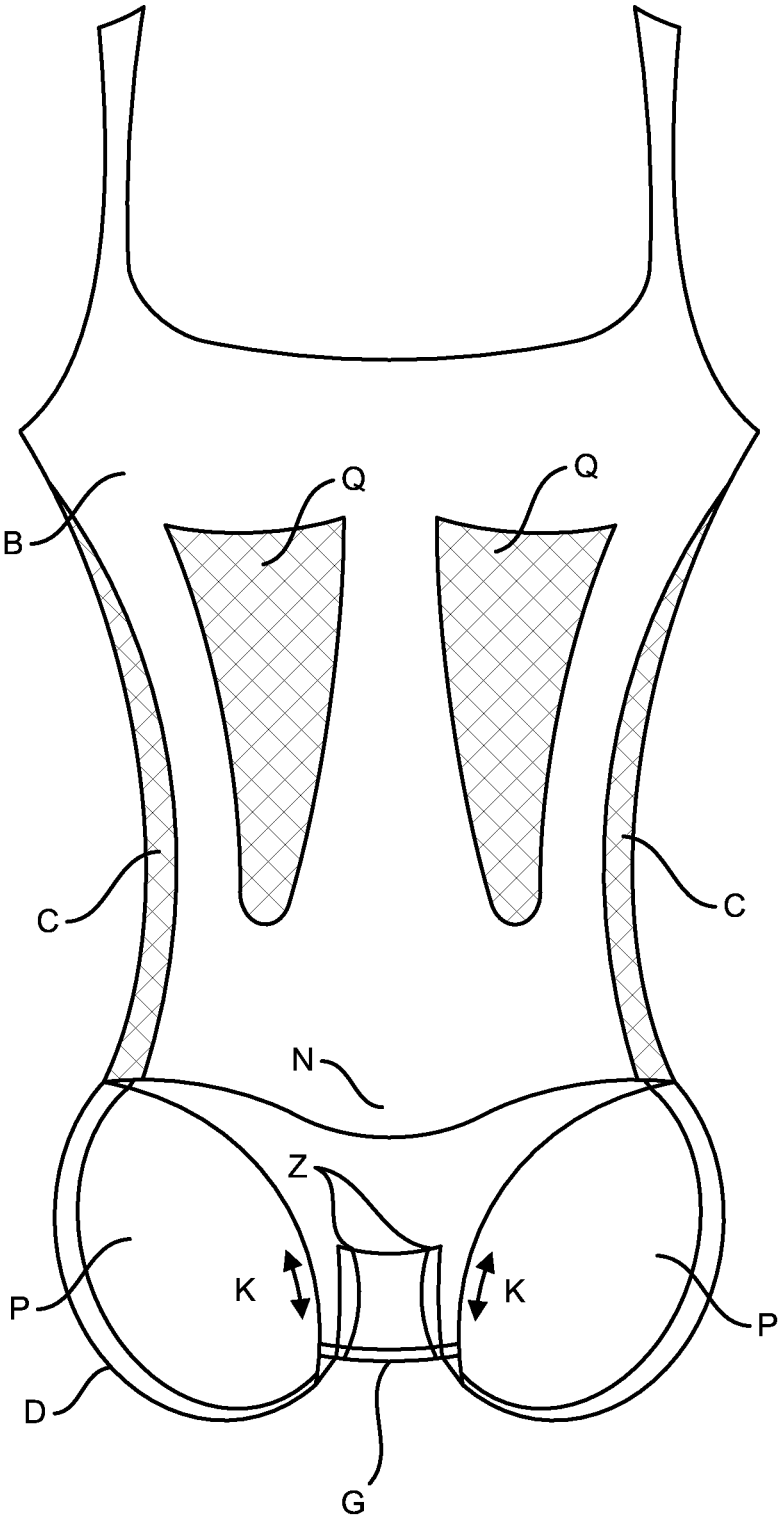
FIG. 2 is a back view of the Shapewear apparatus in accordance with an embodiment of the present disclosure.

FIG. 2 is a back view of the Shapewear apparatus showing many of the same or similar reference lines and reference characters as in FIG. 1. The backview emphasizes the buttocks lifting connection strap or panel. The sliding crotch seen from the back view emphasizes the span of the sliding action from the front to the back. The back view also includes the tail bone curvature N designed to emphasize and to distinguish the left and the right reinforced buttocks panels D and straps. The back view also illustrates the left and the right reinforced back panels Q extending below a respective shoulder blade to just above the tail bone curvature N. The left and the right reinforcing buttocks panels P, a crotch portion X and an interlocking or sliding longitudinal edges Z are also illustrated.

The sliding panel is in communication with crotch portions of the disclosed garment in accordance with an embodiment of the disclosure. Interlocking longitudinal edges of the sliding connection, part or panel G and the interlocking edges of the crotch portion X of the disclosure are in a zip lock arrangement. A zip lock zipper ZL and ZR are thereby achieved on the longitudinal edges of the sliding panel G and the crotch portion X of the disclosed garment. The arrows indicate respective vectors for a slidable communication between the sliding connection, part or panel G and the disclosed garment edges. An optional panel piece F implementation of G provides closure for the opening E of FIG. 1 and attaches along the crotch area of the body shaping garment via the ZL and the ZR zip lock longitudinal seams, zippers or snaps in embodiments of the disclosure.

Figure 3:
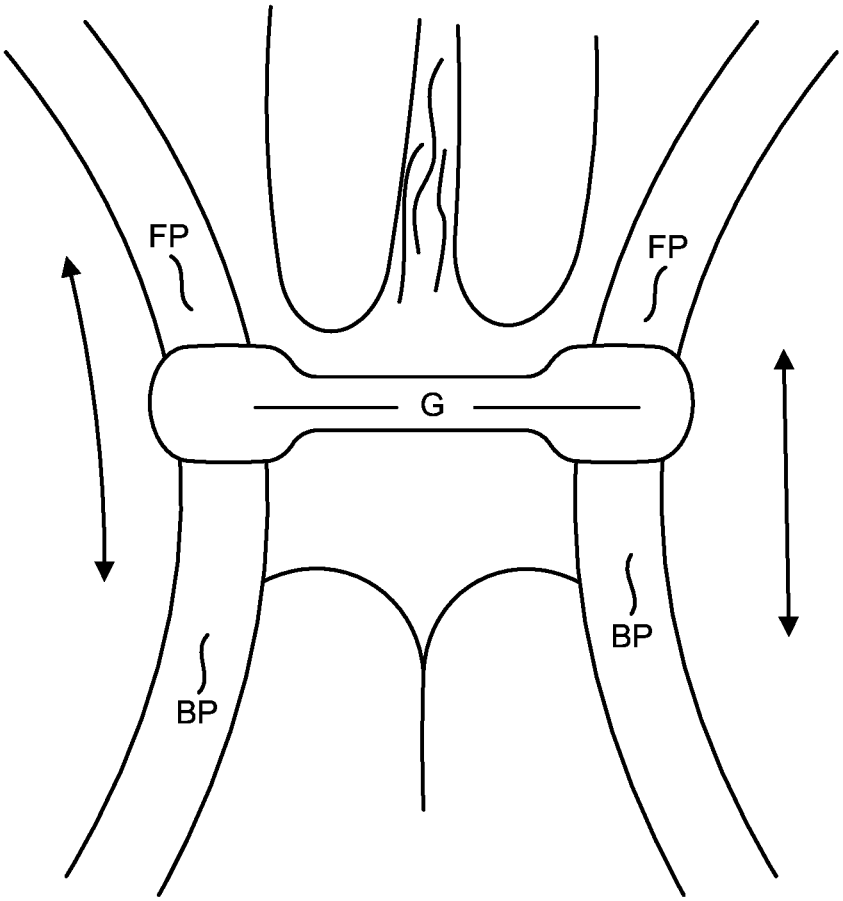
FIG. 3 is a close up bottom view of the perineum slide between the buttocks and the vulva of a user in accordance with an embodiment of the present disclosure.

FIG. 3 is a close up bottom view of the slide for a perineum between the buttocks (bottom cleavage in the depiction) and the vulva (top labia in the depiction) of a user in accordance with an embodiment of the present disclosure. The sliding connection, part or panel G in the perineum links the back side or back panel BP of the disclosed shapewear with the front side or front panel FP thereof and slides along respective sides between the buttocks and the vulva according to the arrows to accommodate comfort in any female user.

Figure 4:
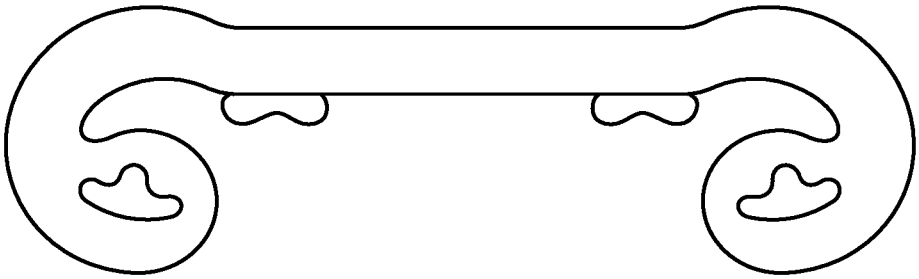
FIG. 4 is a detailed view of the sliding connection, part or panel with connector groove and ridge zipper lock or zip lock arrangement or snaps in the perineum area of a user in accordance with an embodiment of the present disclosure.

FIG. 4 is a detailed view of the sliding connection, part or panel G with groove V and ridge R zipper lock or zip lock arrangement or snaps in the perineum area of a user in accordance with an embodiment of the present disclosure. The slide connection G when closed defines two openings O for sliding on parts of the front panel FP to the back panel BP. The sliding connection is made of nylon, rayon and other slidable materials and also made of the same materials as the front panel and the back panel in various embodiments of the disclosure. The slide connector G is removable with interlocking, zipping or snapping parts R and V for respective male ridge or zip/snap parts and female groove or zip/snap parts on both sides of the slide connector which forms a zipper lock or zip lock longitudinal seam ZL and ZR for respective left and right zip lock longitudinal seams.

The present disclosed Shapewear, aka "The Most Comfortable Effective Body Shaper", introduces an unprecedented, non-restrictive shapewear that can be worn under any article of clothing discreetly and comfortably. Expanding on the initial design of current shapewear designs, the Most Comfortable Effective Body Shaper presents a novel polyester elastic body shaper that lifts the buttocks and breast region, due to the extra added pieces, while simultaneously smoothing and flattening the stomach. Constructed with secure back support, this accessory covers high up back fat and pulls the excess skin in, as well as the stomach area, to ensure a curvy flattering aesthetic that complements an individual's natural form to that point that the body-shaper does not feel restrictive, even during long term wear. The highly adjustable nature of the Most comfortable Effective Body Shaper guarantees an individual's entire abdominal area is adequately covered and allows users to alter the positioning of the optional opening attachment located in the genital or crotch area to enable users to use the bathroom without complication or the necessity to remove the entire garment. The most Comfortable Effective Body Shaper introduces a form fitting yet extremely comfortable undergarment that molds onto the original creases of the body providing complete support and coverage of the midsection in order to create an effortless hourglass figure, for women of all ages. The sliding panel over the genital or crotch area is also a prophylactic against disease as it is replaceable and launderable separately.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

What is claimed is:

1. A body shaping garment comprising:

an elastic torso comprising a right reinforced side panel, a left reinforced side panel, a front reinforced panel, a front main panel, a back panel, a left strap, and a right strap;

a right reinforced buttocks panel and a left reinforced buttocks panel adjacent the back panel;

a sliding crotch part disposed between the front main panel and the back panel along a crotch area of the body shaping garment, wherein the sliding crotch part allows bowel and urinary egress and is configured to span a perineum area of a user and wherein the sliding crotch part is replaceable;

a zipper disposed down the front reinforced panel and configured to follow a curvature of the front panel, the zipper further configured to extend adjacent a pair of breasts of the user; and wherein the sliding crotch part slides from the front main panel to the back panel along the crotch area of the body shaping garment via a left zip lock longitudinal seam and a right zip lock longitudinal seam.

2. The body shaping garment of claim 1, further comprising a left back reinforcing panel and a right back reinforcing panel configured to extend below respective left and right shoulder blades of the user and above the reinforced buttocks panels.

3. The body shaping garment of claim 1, wherein the body shaping garment further includes connecting straps between the front main panel and the back panel.

4. The body shaping garment of claim 1, wherein the front main panel comprises a breast lifting lip disposed along a curvature of a top edge of the front main panel in relation to a bottom crotch edge.

5. The body shaping garment of claim 1, wherein the sliding crotch part slides out and away from the crotch area of the body shaping garment to separately launder and replace.

6. The body shaping garment of claim 1, wherein an overall shape of the body shaping garment resembles an hour glass profile.

7. The body shaping garment of claim 1, wherein the front main panel comprises an upper curvature that is lower than an upper curvature of the back panel.

8. The body shaping garment of claim 1, further comprising a tail bone curvature on the back panel designed to emphasize the adjacent right reinforced buttocks panel and left reinforced buttocks panel.

9. A body shaping garment system comprising:

an elastic torso comprising a right reinforced side panel, a left reinforced side panel, a front reinforced panel, a front main panel, a back panel, a left strap, and a right strap;

a right reinforced buttocks panel and a left reinforced buttocks panel adjacent the back panel;

a sliding crotch panel adjoining the front main panel and the back panel, wherein the sliding crotch panel allows bowel and urinary access and spans a crotch area of the body shaping garment system;

a zipper disposed down the front reinforced panel and configured to follow a curvature of the front main panel, the zipper further configured to extend adjacent to a pair of breasts of a user; and wherein the sliding crotch panel slides from the front main panel to the back panel along the crotch area of the body shaping garment system via a left zip lock longitudinal seam and a right zip lock longitudinal seam.

10. The body shaping garment system of claim 9, further comprising a left back reinforcing panel and a right back reinforcing pane; configured to extend below respective left and right shoulder blades of the user and above the left and the right reinforced buttocks panels.

11. The body shaping garment system of claim 9, wherein the body shaping garment system further includes connecting straps between the front main panel and the back panel.

12. The body shaping garment system of claim 9, wherein the front main panel comprises a breast lifting lip disposed along a curvature of a top edge of the front main panel in relation to a crotch edge.

13. The body shaping garment system of claim 9, wherein the sliding crotch panel slides out and away from the crotch area of the body shaping garment system to separately launder and replace.

14. The body shaping garment system of claim 9, wherein an overall shape of the body shaping garment system resembles an hour glass profile.

15. The body shaping garment system of claim 9, wherein the front main panel comprises an upper curvature that is lower than an upper curvature of the back panel.

16. The body shaping garment system of claim 9, further comprising a tail bone curvature on the back panel designed to distinguish the adjacent right reinforced buttocks panel and left reinforced buttocks panel.

* * * * *